US005083110A

United States Patent [19]

Ahrens

[11] Patent Number: 5,083,110

[45] Date of Patent: Jan. 21, 1992

[54] WINDOW ALARM SYSTEM

[76] Inventor: Richard Ahrens, P.O. Box 613, Hamlin, Pa. 18427

[21] Appl. No.: 649,987

[22] Filed: Feb. 4, 1991

[51] Int. Cl.[5] ..... G08B 13/00; H01H 3/02

[52] U.S. Cl. ..... 340/541; 200/61.93; 340/666; 340/693

[58] Field of Search ..... 340/541, 545, 665-666, 340/693; 200/85 R, 86.5, 61.81-61.82, 61.76, 61.62, 61.93; 367/188

[56] References Cited

U.S. PATENT DOCUMENTS

Re. 32,180 6/1986 Lewiner et al. ..... 340/666 X
4,539,560 9/1985 Fleck et al. ..... 340/666 X
4,617,433 10/1986 Hoshikawa et al. ..... 340/666 X
4,703,313 10/1987 Husmann et al. ..... 340/550
4,763,110 8/1988 Zucker ..... 340/541
4,855,716 8/1989 Jordal ..... 340/541 X
4,963,705 10/1990 Broderick et al. ..... 340/666 X

*Primary Examiner*—Glen R. Swann, III
*Assistant Examiner*—Thomas J. Mullen, Jr.
*Attorney, Agent, or Firm*—Terry M. Gernstein

[57] ABSTRACT

A window alarm system includes a plurality of small, self-contained units strategically located on the window. The units are either spring-controlled or transducer-controlled, and are set to activate an alarm upon the application of a predetermined amount of pressure thereto.

12 Claims, 3 Drawing Sheets

WINDOW ALARM SYSTEM

TECHNICAL FIELD OF THE INVENTION

The present invention relates to the general art of alarm systems, and to the particular field of intruder alarm systems.

BACKGROUND OF THE INVENTION

Illegal intrusion is a very real and dangerous problem presented to nearly all property owners or occupiers. As a result of such problem, many people place special locks and bars on their doors and windows, have special security guards and/or special alarm systems. Accordingly, the alarm system art has included a plethora of various alarm devices intended to prevent, or at least, signal such intrusion.

One common point of illegal entry into a home or an apartment has been via a window. The window is broken or cut, and entry is gained via such breached window. Therefore, the alarm art has included several designs intended to signal such a breach. These designs have included window screens that trigger an alarm if cut, window pane sensors that signal if the window pane is cut or broken or the like. The art also includes alarm devices such as disclosed in U.S. Pat. No. 4,763,110, that are intended to signal when an intruder places his weight on the window sill associated with the window.

However, such presently available window alarms generally have several drawbacks that have inhibited the full use and commercial acceptance of such devices.

For example, it is well accepted in the alarm art that there is no such thing as a defeat-proof alarm. That is, if a potential intruder discovers the alarm system, it must be assumed that he will be able to defeat it, either by physically disabling it or be simply avoiding it. Many of the presently-available window alarm systems are located in positions that expose them to discovery by a potential intruder thereby raising the just-discussed possibility of defeat or circumvention thereof.

Another problem with many presently-available window alarm systems is that they are exposed to the weather elements and to other situations that may raise the possibility of damage to the alarm or to generating false alarms, or worse, to the possibility of not signalling an alarm when an actual illegal intrusion is occurring. Thus, if a window alarm system is located on the outside sill of a window, that alarm will be contacted by rain, snow and the like, and is thus subject to having the elements thereof degraded to a level that may create the possibility of generating a false alarm, or having the system not generate an alarm at all, even if contacted by an intruder. On the other hand, if the system is located on the outside of the window, birds, squirrels or other such small animals often found near homes can set of the alarm by simply sitting on the window sill, thereby creating a false alarm situation.

Another problem with many presently-available window alarm systems is that they do not lend themselves to easy and quick installation thereby discouraging a property owner from purchasing such alarm, or removing such alarms after a certain period so that they can be repaired or replaced as necessary.

Still a further drawback with many presently-available window alarms is that they do not lend themselves to customizing the particular alarm system to fit the precise needs of the property owner. That is, systems, such as the system disclosed in the above-mentioned patent, cover the entire window sill, and thus the entire window is protected by only a single alarm. If that single alarm is defeated, or fails, the entire window is subject to being breached, or if one part of the system is accidentally set off, the entire system is activated. This is not the most efficient and effective way to protect a window, especially if one part of the window is subject to different intrusion and protection considerations than other parts of that same window.

Therefore, there is a need for a window alarm system that is installable in a manner that will permit it to be placed in a location that can be hidden from a potential intruder and yet will be easy and inexpensive to install and is not subject to degradation or false alarms and will permit easy and inexpensive customizing of the window alarm system to fit the exact needs of a particular window.

OBJECTS OF THE INVENTION

It is a main object of the present invention to provide a window alarm system that is installable in a manner that will permit it to be placed in a location that can be hidden from a potential intruder.

It is another object of the present invention to window alarm system that is installable in a manner that will permit it to be placed in a location that can be hidden from a potential intruder and yet will be easy and inexpensive to install.

It is another object of the present invention to window alarm system that is installable in a manner that will permit it to be placed in a location that can be hidden from a potential intruder and yet will be easy and inexpensive to install and is not subject to degradation or false alarms.

It is another object of the present invention to window alarm system that is installable in a manner that will permit it to be placed in a location that can be hidden from a potential intruder and yet will be easy and inexpensive to install and is not subject to degradation or false alarms and will permit easy and inexpensive customizing of the window alarm system.

It is another object of the present invention to window alarm system that is installable in a manner that will permit it to be placed in a location that can be hidden from a potential intruder and yet will be easy and inexpensive to install and is not subject to degradation or false alarms and will permit easy and inexpensive customizing of the window alarm system and can be customized to fit the exact needs of a particular window.

SUMMARY OF THE INVENTION

These, and other, objects are achieved by a window alarm system that is totally self-contained in a small unit that includes a monolithic, one-piece housing. The unit is thus easily hidden so that several units can be placed at various, and strategic, locations on the window and the sill, with the units that are exposed to the weather elements are designed in such a manner as to be nearly totally unaffected by such exposure. The units are also adjustable so that various degrees of sensitivity can be set on each or on several units, whereby some units on the same sill have a greater degree of sensitivity than others. The units can also be moved, removed and replaced as necessary whereby the protection system can be properly maintained.

In this manner, the small, one-piece, self-contained nature of the units can be easily installed in as many locations as possible by the property owner himself so that technician time and expenses are avoided. The alarm system can be initially customized to fit the exact needs of the window, but can be recustomized as necessary by the property owner himself. One or more of the units will be hidden so that a potential intruder is likely to overlook such hidden units and thus remove the possibility of circumventing such hidden units. Should the intruder find some units, he may be lulled into believing that he has found all of the units and thus be fooled into activating one of the hidden units. The closed self-contained nature of the units also will prevent damage to the elements thereof by water or the like if the unit is located outside the window.

BRIEF DESCRIPTION OF THE DRAWING FIGURES

DETAILED DESCRIPTION OF THE PREFERRED EMBODIMENT OF THE INVENTION

Figure 1:
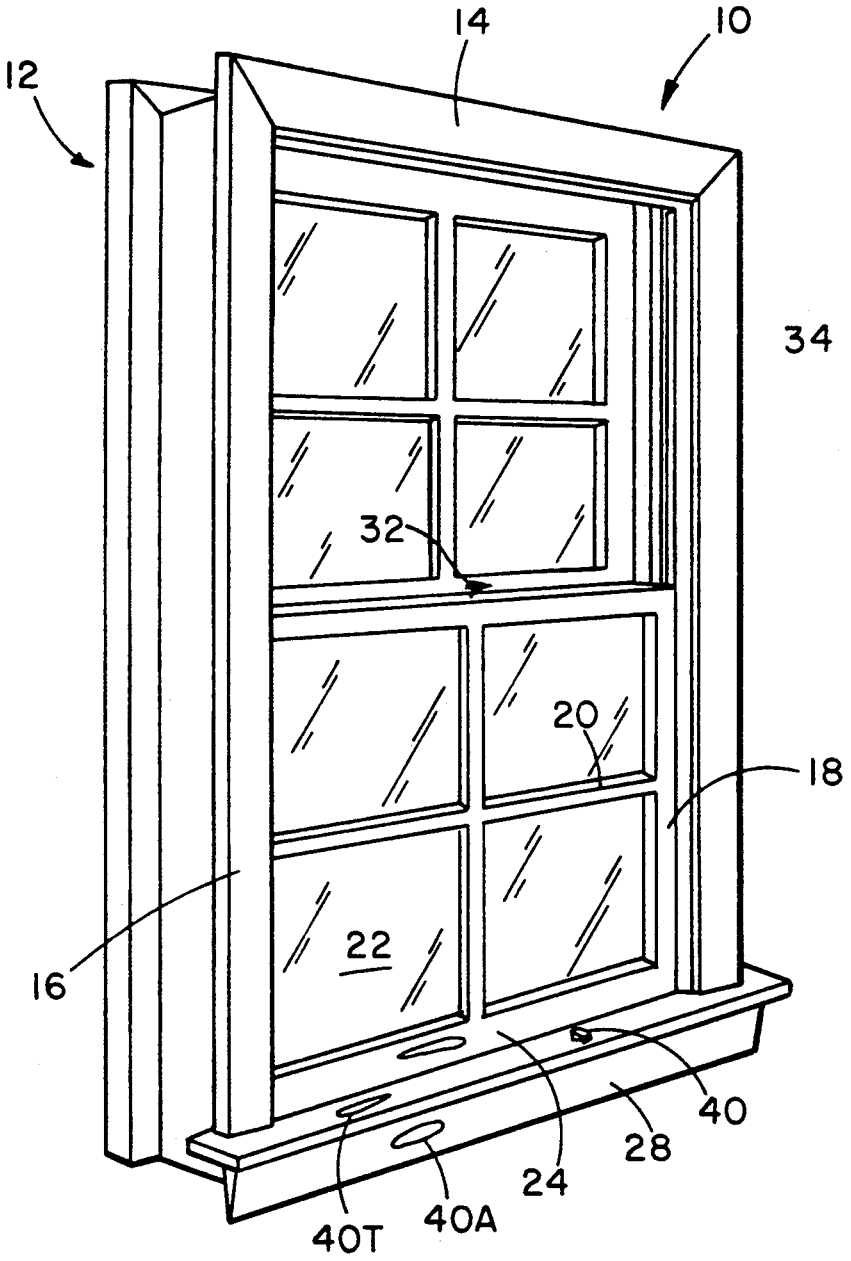
FIG. 1 is perspective view of a window having the window alarm system of the present invention installed thereon.

Shown in FIG. 1 is a typical window 10 that is commonly used in many buildings. The window 10 includes an exterior portion 12, and an interior portion 14, with the exterior and interior portions being similar. The window includes a casing 16 in which a stile 18 containing sash bars 20 is mounted to contain window panes 22.

The stile includes a bottom rail 24 which engages a stool portion 26 of an apron 28. The apron and stool portion form the window sill 30 of the window. The window includes an interior sill and an outside sill which are identical, except that the outside sill need not include an apron. A suitable lock 32 can also be included to lock the lower sash 18 to an upper sash 34.

A window alarm system embodying the present invention includes a plurality of separate and self-contained units, such as unit 40, mounted at various locations about the window 10. The units 40 are shown on the inside of the window, but will be located on the outside in addition to or in lieu of such inside units.

The units are self-contained and thus can be located anywhere and will operate independently of other units. Thus, each unit can be located in a strategic location. For example, several units 40T can be located on top of the sill at various orientations, one unit 40A can be located on the apron, one unit 40R can be located on the bottom rail 24 and the like. In this manner, a potential intruder may spot one unit, but is likely to overlook other units. If a unit is not observed, it is likely that it will not be circumvented or defeated. Still further, should one unit malfunction, there are other units that are still operative and thus the overall system is still likely to be activated by an intruder, and the malfunctioning unit can be removed and replaced without requiring the entire system to be replaced or removed. Still further, the self-contained units can be moved around during initial installation to specifically tailor the system to the particular needs of the window, and yet the system can also be altered after initial installation to account for changes in concept of system coverage, or to better fit the needs of a property owner—without requiring the entire system to be removed and redesigned. Additional units can be added to further customize the system to the particular window, and, as will be discussed below, the sensitivity of these units can be set differently from the sensitivity of the extant units whereby further customizing can be achieved.

Figure 2:
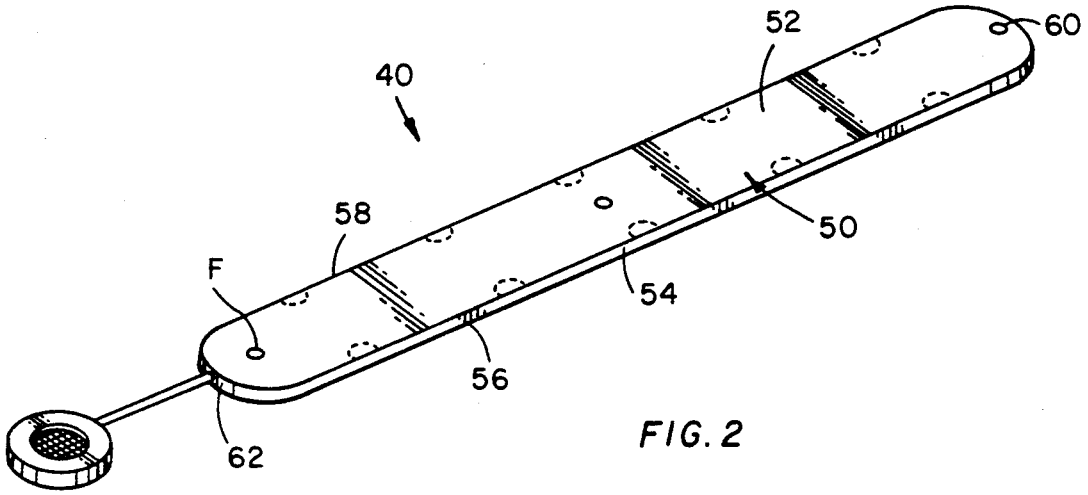
FIG. 2 is a perspective view of a spring-loaded unit used in the window alarm system.
Figure 3:
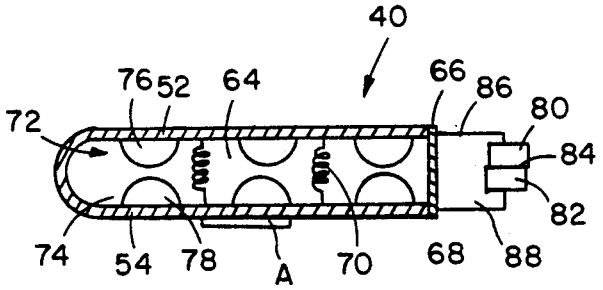
FIG. 3 is a cutaway side elevational view of the spring-loaded unit.

As best shown in FIGS. 2 and 3, each unit 40 includes a monolithic, one-piece housing 50. The monolithic, one-piece nature of the housing prevents water from damaging the element if that element is exposed to the weather. The housing includes a top 52 a bottom 54, sides 56 and 58 and ends 60 and 62. Fastening means, such as screw fasteners F or adhesive A on the outer surface of the bottom, can be used to affix the housing to the sill or to some other part of the window.

The unit housing 50 has a length dimension as defined between the ends 60 and 62 that is less than three inches, a width dimension as defined between the sides 56 and 58 that is less than one inch and a thickness dimension as defined between the top 52 and the bottom 54 that is less than one-half an inch whereby the overall housing is quite small so it can be hidden in small crevices and small areas on and about the window. In this manner, a plurality of such units can be placed on the window thereby increasing the integrity of the overall system.

The top, bottom, sides and ends of the housing are all formed of a plastics-type material and are all connected to define a chamber 64 within the housing. The top 54 includes a top inner surface 66, and the bottom 54 includes a bottom inner surface 68 which are spaced apart. The housing is flexible so that the top 52 can be forced toward the bottom 54 by pressing either of these elements toward the other. The unit 40 shown in FIGS. 2 and 3 is a spring-biased unit in that a plurality of spaced apart springs, such as spring 70 are attached at one end thereof to the top inner surface 66 and at another end thereof to the bottom inner surface 68 and are set to resist movement of the top and bottom towards each other. The springs each include a spring constant that is set to permit the top and bottom to move towards each other a certain distance upon the application of a pre-set amount of pressure on the top or on the bottom that is directed inwardly of the chamber 64. This pre-set pressure is selected to set the sensitivity of the unit and can be uniform over the entire unit, or can be varied according to the spring. Thus, for example, all of the springs can be set so that a pressure of about twenty pounds per square inch will cause the top and the bottom to move towards each other sufficiently to collapse the chamber, or alternatively, some of the springs can include spring constants that require more than twenty pounds per square inch to permit the top and bottom to move towards each other, and some of the springs can be set to permit a pressure of less than twenty pounds per square inch to move the top and bottom together. Each unit can include its own pre-set force and different units on the same window can have different pre-set pressures required for activation.

Each unit also has an alarm circuit means which includes an electrical contact means 72 mounted on top inner surface 66 and a bottom electrical contact means 74 mounted on the bottom inner surface 68. Each of the contact means includes a plurality of electrical contact elements, such as top contact element 76 and bottom contact element 78, mounted on the top inner surface and the bottom inner surface respectively. The electrical contact elements are located in correspondence with each other to contact each other when the top and the bottom have moved towards each other a distance set according to the pre-set spring constants in co-operation with the natural resiliency of the housing material.

Figure 4:
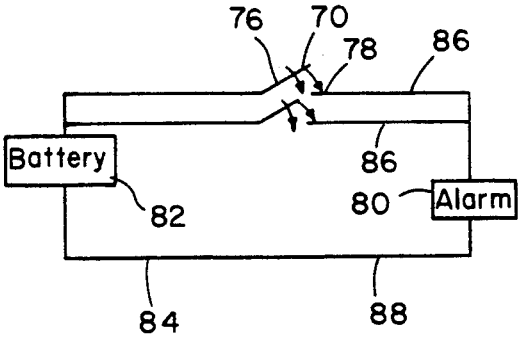
FIG. 4 is a circuit diagram of the window alarm system using the spring-loaded unit shown in FIG. 2.

The alarm circuit means further includes a signal means, such as a horn 80, and a power means, such as a battery 82. The signal means, the power means and the electrical contacts are all connected together as indicated in FIGS. 3 and 4 so that the electrical contact elements act as a plurality of parallel switches between the power means and the signal means. Thus, the horn 80 has one side thereof, such as a positive side, connected to one side of the battery 82 by a first line conductor 84, and a second line conductor 86 connects the other side, such as the negative side, of the horn 80 to the top-mounted contact elements 76. A third line conductor 88 electrically connects the bottom-mounted contact elements 78 to the other side of the battery. The line conductors 86 and 88 are embedded in the housing, and the series nature of the circuit permits contact between any two of the top and bottom contact elements to complete the circuit and activate the alarm signal.

Figure 6:
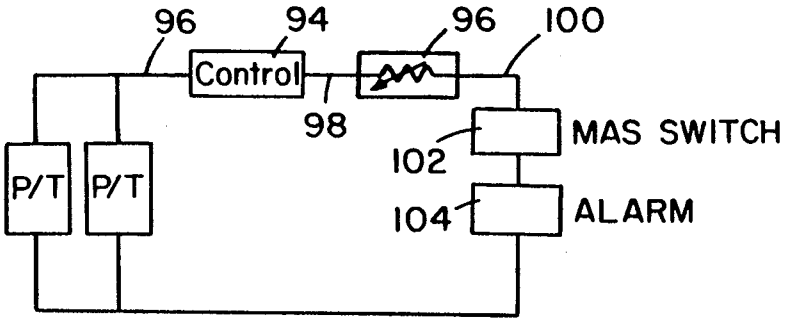
FIG. 6 is a circuit diagram of the window alarm system using the transducer element driven unit shown in FIG. 5.
Figure 5:
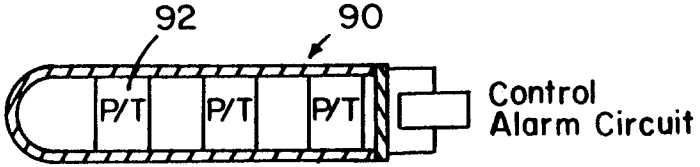
FIG. 5 is a cutaway side elevational view of a transducer element driven unit used in the window alarm system.
Figure 7:
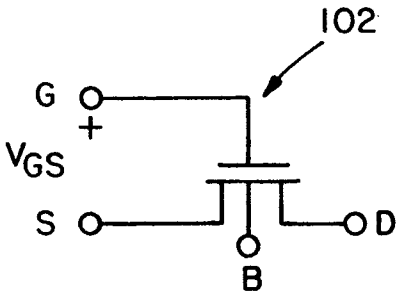
FIG. 7 is a schematic illustration of an MOS switch used in the transducer element driven unit.

A second form of the unit is shown in FIGS. 5, 6 and 7 and will be referred to as a transducer element driven unit 90 as opposed to the spring-loaded unit shown in FIGS. 2–4.

The unit 90 includes the above-discussed monolithic, one-piece housing and the units are situated and oriented as above discussed.

Each unit 90 includes a plurality of active transducer elements, such as element 92 that are force sensitive. For the purposes of this disclosure, an active transducer element is an element that originates and generates an electrical output, such as an output voltage, on its own, in response to force applied thereto. Transducers, including active transducers, are fully discussed in standard textbooks and handbooks such as "Handbook of Modern Electronics and Electrical Engineering", edited by Charles Brelove, and published by Wiley Interscience in 1986, the disclosure of which is incorporated by reference. The elements 92 are connected to a control circuit means 94 by a line conductor 96, and the control circuit means includes amplifiers, power sources and other circuit elements necessary to place the signal output from the transducers 92 in condition to be useful in the alarm system.

A voltage control element, such as a variable resistor 94, is placed in series with the control circuit 94 by a line conductor 98 so that the voltage drop can be adjusted. This adjustment of the voltage drop will adjust the sensitivity of the overall circuit.

Another line conductor 100 electrically connects the voltage control element 96 to an MOS switch 102. The MOS switch 102 is illustrated in FIG. 7 and has a voltage $V_{GS}$ that adjusts the state of the switch. If $V_{GS}$ is below a specified value, the MOS switch acts as an open circuit and thus is "open"; whereas, if $V_{GS}$ is above a specified value, the MOS switch acts as a closed circuit and thus is "closed". The value of $V_{GS}$ is adjusted by the control element 96 which sets the value of the voltage drop associated with the MOS switch. MOS switches are fully disclosed in standard handbooks and standard textbooks such as "Linear Circuits" by M. E. VanValkenburg, and published by Prentice Hall in 1982, the disclosure of which is incorporated herein by reference.

The MOS switch 102 is connected to the alarm element 104, such as a horn, a signal light or a connection to a silent alarm system or to an alarm system that notifies the police or the like as disclosed in the alarm system art, to activate such alarm element upon being closed.

A plurality of units 90 can be used in the system as discussed above in regard to the spring-activated unit, and the transducers 92 can be adjusted to different sensitivities within the same unit or different units can have different sensitivities as above discussed whereby the overall system or a particular unit of the overall system can have a sensitivity that is customized to the particular needs of the specific window and the specific system of interest.

Figure 8:
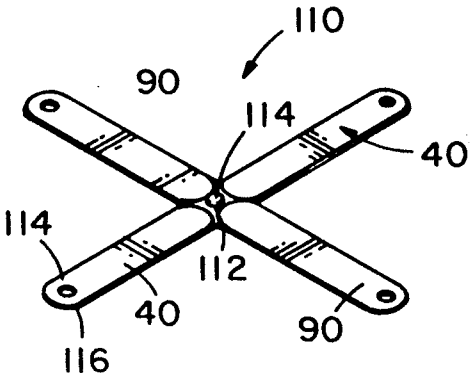
FIG. 8 is a perspective view of an alternative configuration of the units used in the window alarm system.

An example of a special design for the alarm units is shown in FIG. 8 as unit 110. The unit 110 is cruciform in shape and includes four orthoganally oriented units including two units 40 and two units 90 all connected to a central mounting bracket 112. Fastener elements, such as mounting screws, 114, or adhesive, such as glue 116, can be used to mount the unit 110 on the window. Other shapes and combinations of units can be used as will occur to those skilled in the art based on the teaching of the present disclosure.

It is understood that while certain forms of the present invention have been illustrated and described herein, it is not to be limited to the specific forms or arrangements of parts described and shown.

I claim:

1. A window alarm system comprising a plurality of self-contained alarm units mounted at various and spaced apart locations on a window, each of said alarm units including (1) a monolithic, one-piece housing which includes
  (a) a top, a bottom, ends and sides, with said top and bottom having outer surfaces,
  (b) a width dimension as measured between said sides that is less than one inch,
  (c) a length dimension as measured between said ends that is less than three inches,
  (d) a thickness dimension as measured between said top outer surface and said bottom outer surface that is less than one-half inch,
  (e) said housing being hollow to have a closed chamber defined therein by said top, said bottom, said sides and said ends, and
  (f) a spring mounted in said chamber and having one end contacting said top and another end contacting said bottom, said spring biasing said top and bottom away from each other and having a spring force that is pre-set to require more than twenty pounds per square inch of pressure on said top to force said top towards said bottom a predetermined amount, and (2) an alarm circuit means which includes
  (a) a top electrical contact means mounted on said top inner surface, (b) a bottom electrical contact means mounted on said bottom inner surface, (c) said top and bottom electrical contact means being oriented to be adjacent to each other and are spaced apart by said predetermined amount to be moved into electrical contact with each other when said housing top and said housing bottom are moved toward each other said predetermined amount, and (d) a signal circuit means which includes (i) a housing, (ii) a signal means in said signal circuit means housing, (iii) a power source in said signal circuit means housing, (iv) a first line conductor electrically connecting one side of said signal means to one side of said power source, (v) a second line conductor electrically connecting another side of said signal means to said top electrical contact means, and (vi) a third line conductor electrically connecting another side of said power source to said bottom electrical contact means.

2. The window alarm system defined in claim 1 further including adhesive means on an outer surface of said housing bottom.

3. The window alarm system defined in claim 2 wherein said top electrical contact means includes a plurality of top electrical contact elements which are spaced apart from each other and each of which is electrically connected to said second line conductor and said bottom electrical contact means includes a plurality of bottom electrical contact elements which are spaced apart from each other and each of which is located adjacent to one of said top electrical contact means elements and is electrically connected to said third line conductor.

4. The window alarm system defined in claim 3 wherein said monolithic, one-piece housing is formed of plastics-type material.

5. The window alarm system defined in claim 4 further including a at least two springs, with said springs each having different spring constants.

6. The window alarm system defined in claim 5 wherein said signal circuit means housing is spaced from said monolithic, one-piece housing.

7. The window alarm system defined in claim 6 wherein said signal circuit means signal means includes a horn.

8. A window alarm system comprising a plurality of self-contained alarm units mounted at various and spaced apart locations on a window, each of said alarm units including (1) a monolithic, one-piece housing which includes (a) a top, a bottom, ends and sides, with said top and bottom having outer surfaces, (b) a width dimension as measured between said sides, (c) a length dimension as measured between said ends, (d) a thickness dimension as measured between said top outer surface and said bottom outer surface, and (e) said housing being hollow to have a closed chamber defined therein by said top, said bottom, said sides and said ends, and (2) an alarm circuit means which includes (a) a plurality of active transducer elements mounted inside said chamber, said active transducer elements being spaced apart from each other and having one end in abutting contact with an inner surface of said housing top and another end in abutting contact with said bottom and generating an output voltage signal in response to force applied to said top and said bottom in a direction to force said top and bottom toward each other, said output voltage exceeding a predetermined value when a preset amount of force is applied to said housing in a direction to force said top and bottom toward each other, (b) a transducer voltage output signal conditioning circuit means electrically connected to each of said active transducers, (c) a voltage output signal strength adjusting circuit means connected to said output signal conditioning circuit means, (d) an MOS switch connected to said voltage output signal strength adjusting circuit means to be closed when voltage applied thereto exceeds said predetermined value and to be open when voltage applied thereto is less than said predetermined value, and (e) a signal means connected to said MOS switch to be connected to said power source when said MOS switch is closed.

9. The window alarm system defined in claim 8 wherein each of said active transducers has a voltage output to force applied thereto ratio, and each of said ratios is different from other ratios.

10. The window alarm system defined in claim 9 further including a mounting bracket, with said self-contained alarm unit being connected to said mounting bracket, and further includes a spring-biased self-contained unit connected to said mounting bracket, said spring-biased self-contained unit including (1) a second monolithic, one-piece housing which includes (a) a top, a bottom, ends and sides, with said top and bottom having outer surfaces, (b) a width dimension as measured between said second housing sides, (c) a length dimension as measured between said second housing ends, (d) a thickness dimension as measured between said second housing top outer surface and said second housing bottom outer surface, (e) said second housing being hollow to have a closed chamber defined therein by said second housing top, said second housing bottom, said second housing sides and said second housing ends, and (f) a spring mounted in said chamber and having one end contacting said second housing top and another end contacting said second housing bottom, said spring biasing said second housing top and second housing bottom away from each other and having a spring force that is pre-set to require more than a predetermined amount of pressure on said second housing top to force said second housing top towards said second housing bottom a predetermined amount, and (2) a spring-controlled alarm circuit means which includes (a) a top electrical contact means mounted on said second housing top inner surface, (b) a bottom electrical contact means mounted on said second housing bottom inner surface, (c) said second housing top and second housing bottom electrical contact means being oriented to be adjacent to each other and are spaced apart by said predetermined amount to be moved into electrical contact with each other when said second housing top and said second housing bottom are moved toward each other said predetermined amount, and (d) a signal circuit means which includes (i) a third housing, (ii) a signal means in said signal circuit means third housing, (iii) a second power source in said signal circuit means third housing, (iv) a first lead line electrically connecting one side of said signal means to one side of said second power source, (v) a second lead line electrically connecting another side of said signal means to said second housing top electrical contact means, and (vi) a third lead line electrically connecting another side of said power source to said second housing bottom electrical contact means.

11. The window alarm system defined in claim 10 wherein said second housing top electrical contact means includes a plurality of second housing top electrical contact elements which are spaced apart from each other and each of which is electrically connected to said second lead line and said second housing bottom electrical contact means includes a plurality of bottom electrical contact elements which are spaced apart from each other and each of which is located adjacent to one of said second housing top electrical contact means elements and is electrically connected to said third lead line.

12. The window alarm system defined in claim 11 wherein said second housing further includes at least two springs, with said second housing springs each having different spring constants.

* * * * *